United States Patent [19]

Keilhack et al.

[11] 3,934,837

[45] Jan. 27, 1976

[54] WEB WINDER AND COMPENSATOR APPARATUS

[75] Inventors: Hans O. Keilhack; Peter Schmidt, both of Charlotte, N.C.

[73] Assignee: Keiltex Corporation, Charlotte, N.C.

[22] Filed: Oct. 4, 1974

[21] Appl. No.: 512,361

[52] U.S. Cl. ..... 242/75.5; 242/67.5; 242/75.53

[51] Int. Cl.[2] ..... B65H 59/00

[58] Field of Search..... 242/75.5, 75.51, 75.52, 242/75.53, 67.5, 187, 67.1 R

[56] References Cited

UNITED STATES PATENTS

| | | | |
|---|---|---|---|
| 1,706,165 | 3/1929 | Hull | 242/75.51 |
| 2,343,181 | 2/1944 | Heinz | 242/75.53 X |
| 2,916,227 | 12/1950 | Bowen | 242/75.5 |
| 3,239,161 | 3/1966 | Dufro | 242/75.5 X |
| 3,341,198 | 9/1967 | Cooper | 242/75.5 |
| 3,650,490 | 3/1972 | Saunders | 242/25.53 |
| 3,701,493 | 10/1972 | Welsch | 242/67.5 |

*Primary Examiner*—Edward J. McCarthy

*Attorney, Agent, or Firm*—Parrott, Bell, Seltzer, Park & Gibson

[57] ABSTRACT

An improved web winder and compensator apparatus with automatic web winding speed compensating controls for selectively winding or unwinding at a uniform tension a roll of traveling continuous web material being selectively fed from or taken up by an associated mechanism, as follows. A tension compensator device passes the traveling web therethrough and compensates for variations in speed of travel of the web for maintaining a uniform tension therein. The compensator device preferably includes stationary rolls for guiding the web through the compensator device and counterbalanced movable rolls for receiving the traveling web therearound and for moving toward and away from the stationary rolls for decreasing and increasing the length of the path of travel of the web through the compensator in relation to the tension on the traveling web. The movable rolls are preferably movable to a threading position for straightline linear threading up of the web through the compensator device. A variable speed, center drive, reversible winder mechanism is positioned adjacent the compensator device for selectively winding or unwinding a roll of the web material. Control mechanisms including a device for sensing the diameter of the web roll in the winder mechanism are provided and are operatively connected between the compensator device and the winder mechanism for controlling the winding or unwinding speed of the winder mechanism in relation to and in response to the speed of travel of the web through the compensator device and the diameter of the web roll for maintaining a uniform tension in the web material being wound or unwound. Preferably, the winder and compensator apparatus are of a self-containing, space-saving construction in which a housing mechanism carries the apparatus and is constructed for being suspended from a ceiling of a manufacturing plant to conserve floor space.

17 Claims, 9 Drawing Figures

WEB WINDER AND COMPENSATOR APPARATUS

BACKGROUND OF INVENTION

This invention relates to an improved web winder and compensator apparatus, preferably of an easy threading and a space-saving, self-contained construction, with automatic web winding speed compensating controls for selectively winding or unwinding at a uniform tension a roll of traveling continuous web material being selectively fed from or taken-up by an associated mechanism.

In various manufacturing operations for producing textiles, felts, papers, films, etc., it is necessary to wind or unwind a roll of traveling continuous web material being processed in the manufacturing operation as it is being fed from or taken up by an associated mechanism. This is particularly true in the textile field with various machines utilized during the manufacture and finishing of the textile fabric, such as tenter frames, cloth inspection stations, etc. As the cloth is fed from a tenter frame mechanism, for example, it is desirable to wind the cloth under uniform tension into a super or jumbo roll of cloth for transportation to subsequent processing operations. Also, for example, during the inspection of cloth at various stages of its manufacture and finishing operations, it is necessary to unwind a jumbo or super roll of cloth at a uniform tension for inspection thereof by an operator.

Although various mechanisms and apparatus have been proposed for these and other winding and unwinding operations, problems have been presented in maintaining a uniform tension in the web material being wound and unwound and in the provision of adequate floor space for such winding apparatus inasmuch as floor space is usually at a premium in most manufacturing plants. The problems with the maintaining of uniform tension during the winding and unwinding operations result from variable speeds of feed from an associate mechanism or variable speeds of take-up by an associated mechanism. Unless this variable speed and resulting variable tension is compensated for, the resulting wound or unwound roll will have undesirable characteristics.

Additionally, most of the heretofore proposed winding mechanisms have been of the center drive type in which the mandrel or roll upon which the web of material is being wound is directly driven for winding or unwinding a roll of the continuous web material. With the use of this type of mechanism, the speed of rotation of the mandrel must be compensated for in accordance with the increasing or decreasing diameter of the roll being wound or unwound. Although proposals have been made for compensating for this increasing and decreasing diameter or the roll of web material being wound or unwound, the prior proposed mechanisms have suffered from drawbacks in compensating for both the variable tension in the traveling web as a result of varying speeds of feed as well as compensating for the increasing diameter of the roll of web material being wound or unwound.

Some of the proposals for winding or unwinding rolls of continuous web material have included compensator devices of the dancing roll type which include stationary rolls and movable rolls in which the movable rolls move toward or away from the stationary rolls to increase or decrease the length of the path of travel of the continuous web through the compensator mechanism for maintaining uniform tension in the compensator mechanism. However, these types of compensator mechanisms have presented problems in threading up of the continuous web material therethrough inasmuch as the movable rolls and stationary rolls define a sinuous path of travel for the web material therethrough and, therefore, require considerable effect in threading of the continuous web material through this sinuous path of travel.

Moreover, these types of compensator mechanisms are normally large and space consuming and heretofore have been mounted on the floor of the manufacturing plant adjacent the winding mechanism and adjacent the associated mechanism from which the web material is being fed or taken up by. Accordingly, usable floor space is consumed by these compensator mechanisms.

SUMMARY OF THE INVENTION

It is therefore, an object of this invention to provide an improved web winder and compensator apparatus, with automatic web winding speed compensating controls for selectively winding or unwinding at a uniform tension a roll of traveling continuous web material being selectively fed from or taken-up by an associated mechanism, which overcomes and solves problems presented with previously proposed apparatus.

It is a further more specific object of this invention to provide an improved tension compensator apparatus for a traveling continuous web of material which is characterized by ease in threading up of the web of material through the apparatus and which allows for straightline linear threading up thereof.

It is a still further more specific object of this invention to provide such an improved web winder and compensator apparatus which is specifically constructed for being self-containing and space saving and which is constructed to conserve floor space in a manufacturing plant.

It has been found by this invention that the above objects may be accomplished by providing improved web winder and compensator apparatus, broadly as follows.

Tension compensator means receive the traveling web in a predetermined path of travel therethrough and compensate for variations in speed of travel of the web therethrough for maintaining a uniform tension therein. The compensator means comprises stationary roll means positioned in the path of travel of the web for guiding the web through the compensator means, and counterbalanced movable roll means normally positioned on one side of the stationary roll means for receiving the traveling web therearound and moving toward and away from the stationary roll means for decreasing and increasing the length of the path of travel of the web through the compensator means in relation to the tension on the traveling web.

The movable roll means preferably includes means for movement of the movable roll means to a threading position on the other side of the stationary roll means for straightline linear threading up of the web through the compensator means.

The stationary roll means may comprise a predetermined number, preferably three, spaced-apart parallel rolls extending generally transversely of the traveling web, and the movable roll means may comprise a predetermined number, preferably two, spaced-apart parallel rolls extending generally transversely of the traveling web for movement in planes generally passing through the spaces between the stationary rolls for defining with the stationary rolls a sinuous path of travel for the web therearound.

A variable speed, center driven, reversible winder means is positioned adjacent the compensator means for selectively winding or unwinding a roll of the web material. Preferably, the winder means comprises a portable, fluid operated, reversible motor connected with, extending from and carried by the compensator means for connection to and rotation of a frame supported mandrel for selectively winding or unwinding a roll of the web material on the mandrel.

Control means including means for sensing the diameter of the web roll in the winder means are provided. The control means are operatively connected between the compensator means and the winder means for controlling the winding or unwinding speed of the winder means in relation to and in response to the speed of travel of the web through the compensator means as indicated by the position of the movable roll means of the compensator means and the diameter of the web roll as indicated by the sensing means for maintaining a uniform tension in the web maintain being wound or unwound.

Preferably, the control means include a fluid circuit connected between a fluid source and the fluid operated reversible motor for selectively actuating the motor for forward or reverse rotation, fluid pump and valve means in the fluid circuit means for pumping fluid to the motor for forward or reverse rotation and for regulating the pressure of the fluid being pumped for varying the speed of rotation of the motor, and means operatively connected between the pump and valve means and the movable roll means and the roll diameter sensing means for controlling operation of the pump and valve means in relation to and in response to the speed of travel of the web through the compensator means and the diameter of the web roll.

In accordance with the preferred form of the present invention, housing means is provided for carrying the tension compensator means and the wider motor means and the control means so that the apparatus may be suspended from a ceiling of a manufacturing plant room to conserve floor space.

BRIEF DESCRIPTION OF THE DRAWINGS

Some of the objects and advantages of this invention having been set forth, other objects and advantages will appear as the description proceeds, when taken in conjunction with the accompanying drawings, in which.

DESCRIPTION OF PREFERRED EMBODIMENT

Figure 1:
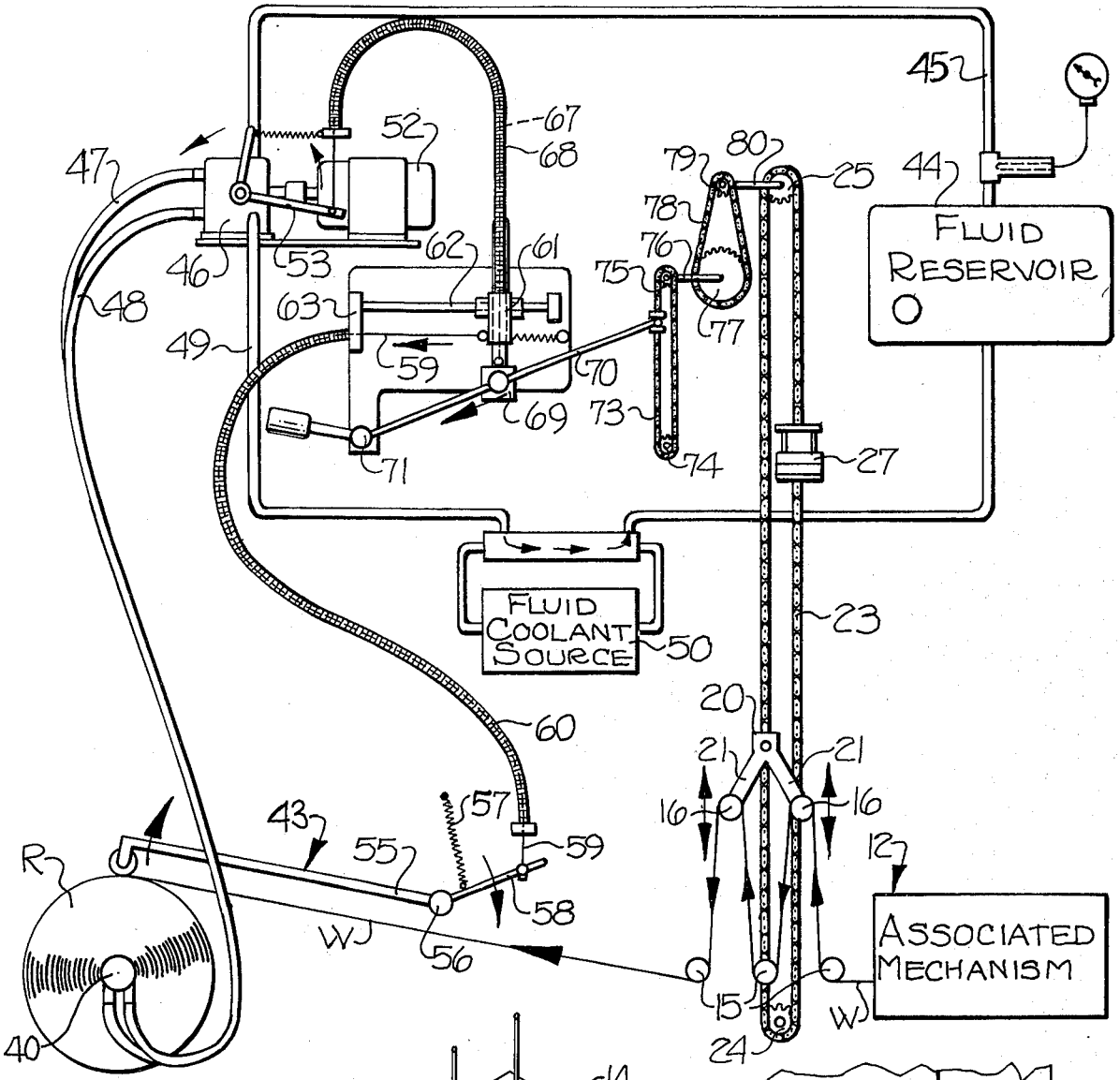
FIG. 1 is a schematic view of the improved web winder and compensator apparatus of this invention.
Figure 2:
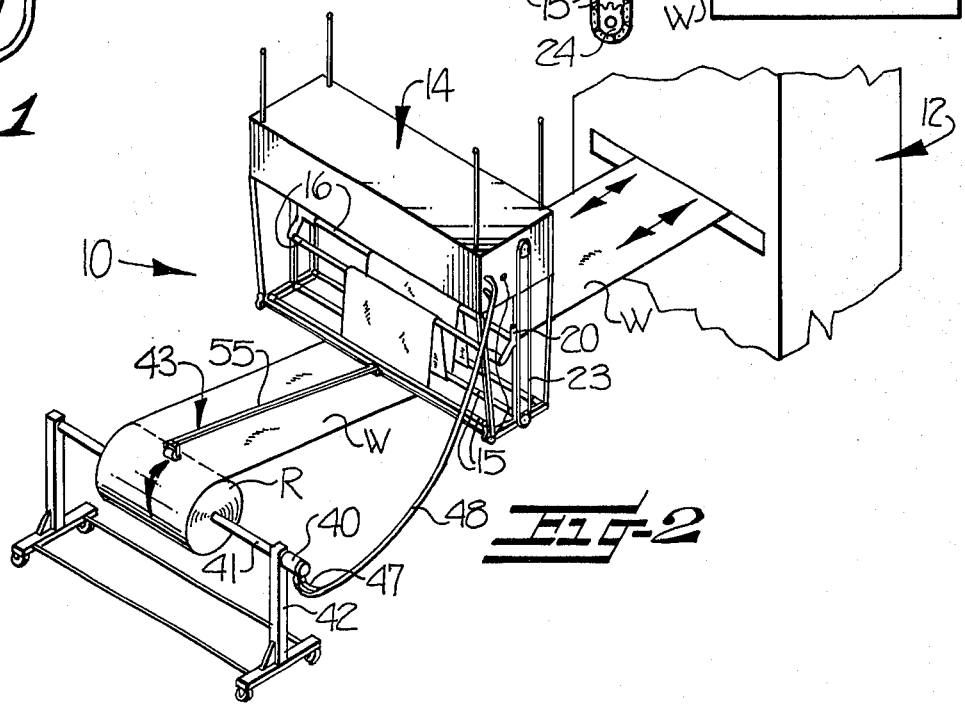
FIG. 2 is a perspective view of the web winder and compensator apparatus of this invention.

Referring now to the drawings, the improved web winder and compensator apparatus is generally indicated by the reference numeral 10. This apparatus 10 is shown schematically in FIG. 1 and a perspective view of a suitable arrangement utilizing this apparatus 10 is shown in FIG. 2. As may be seen in these views, the improved wed winder and compensator apparatus 10 may be utilized in conjunction with an associated mechanism 12 for the winding or unwinding at a uniform tension a roll R of continuous web material W. It is to be noted that in the schematic illustration of FIG. 1, the web W is illustrated as being fed from the associated mechanism 12 and wound into a roll R. However, it is to be understood that the web winder and compensator apparatus 10 of this invention may be utilized whether the web W is being wound or unwound, as indicated by the arrows in FIG. 2. For ease of understanding, the web winder and compensator apparatus 10 will be generally described with respect to the winding of a roll R of a traveling web W received from an associated mechanism 12.

The improved web winder and compensator apparatus 10, as illustrated in the drawings, includes a housing, which is given the composite reference numeral 14 for all of the components thereof, for carrying the web winder and compensator apparatus 10 and is constructed to be suspensed from a ceiling of a manufacturing plant room to conserve space, as shown in FIG. 2. The overall arrangement of the entire improved web winder and compensator apparatus 10 with the housing 14 is a space saving self-contained construction which may be suspended from the ceiling or positioned on the floor and thus eliminates much of the space consumption of previous mechanisms.

The web winder and compensator apparatus 10 includes a tension compensator means for receiving the traveling web W in a predetermined path of travel therethrough and for compensating for variations in speed of travel of the web therethrough for maintaining a uniform tension therein, preferably during winding or unwinding thereof. The compensator means, as illustrated in the drawings, comprises three stationary, spaced-apart, parallel rolls 15 rotatably mounted on downwardly extending portions of the housing 14 and extending generally transversely of and in the path of travel of the web W for guiding the web W through the compensator means. The compensator means further comprises two spaced-apart, parallel rolls 16 movably mounted on the housing 14 and extending generally transversely of the traveling web W for movement in planes passing through the spaces between the three stationary rolls 15. The movable rolls 16 are normally positioned on one side and above the stationary rolls 15 for receiving the traveling web therearound and for defining with the stationary rolls 15 a sinuous path of travel for the web W. The movable rolls 16 are mounted for movement toward and away from the stationary rolls 15 for decreasing and increasing the length of the path of travel of the web W through the compensator means in relation to be tension on the traveling web for compensating for the variation in speed of travel of the web W and for maintaining a uniform tension thereon.

The mounting means for the movable rolls 16 include a slide rod 18 mounted stationary on the downwardly extending portions of the housing 14 on each side of the two movable rolls 16 and extending generally perpendicularly to the movable rolls 16.

A slide member 20 is mounted on each of the slide rods 18 for movement up and down the slide rods 18. Each of the slide members 20 include downwardly and outwardly angularly extending legs 21 which are secured at their upper ends thereof to the slide member 20 and which rotatably carry the movable rolls 16 at the lower ends thereof. Thus, the slide member 20 with its angularly extending legs 21 is generally in the shape of an inverted V, for purposes to be described below.

An endless chain 23 is rotatably carried on a pair of sprockets 24, 25 mounted on the housing 14 for movement in a closed path of travel generally perpendicular to the movable rolls 16. Each of the chains 23 is secured by a bracket 26 to the slide members 20 for movement with the slide members 20 and the movable rolls 16.

A counterbalancing weight device 27 is secured to the chain 23 for biasing the chain 23 and thus the slide 20 and movable rolls 16 in an upward direction to lengthen the path of travel of the web W through the compensator means when the tension on the traveling web W, due to the speed of travel thereof, is below a predetermined amount and allowing the movable rolls 16 to mvoe downwardly toward the stationary rolls 15 against the bias of the weight device 27 under the influence of the tension on the traveling web W when the tension on the traveling web, due to the speed of travel thereof, is above a predetermined amount. The weight device 27 includes a bracket secured to the chain 23 for receiving a desired number of removable weights. The number of weights is calculated by the desired uniform tension to be maintained on the traveling web W and the weight of the movable rolls 16, etc.

Thus, if the traveling web W is under the predetermined desirable amount of tension as it travels through the compensator means, the rolls 16 will be maintained in a desirable position above the stationary rolls 15. However, if the tension in the roll R decreases below a predetermined desired amount, the bias of the weight device 27 will cause rotation of the chain and sprocket device 23, 24, 25 to move the slide 20 and thus the movable rolls 16 upwardly to lengthen the path of travel of the web W through the compensator means and thereby increase the tension on the web W to the predetermined desired amount. The converse of the above operation also occurs when the tension increases in the traveling web W and the movable rolls 16 will be moved by this increased tension against the bias of the weight device 27 toward the stationary rolls 15 to shorten the length of travel of the web W through the compensator means for decreasing the tension on the traveling web W.

Figure 4:
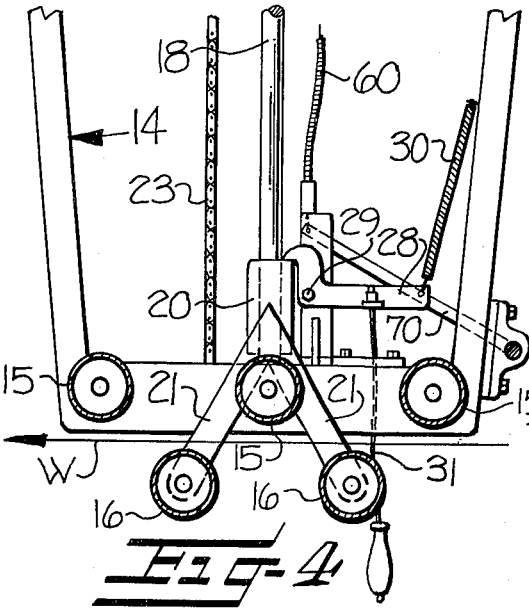
FIG. 4 is a partial, cross-sectional view of the compensator apparatus of this invention illustrating the movable rolls thereof in the straightline linear threading position thereof.
Figure 5:
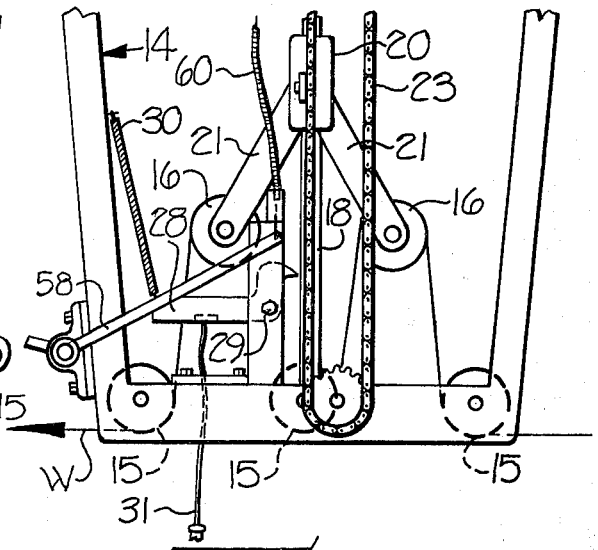
FIG. 5 is a cross-sectional view of the apparatus of FIG. 4, taken from a different direction, and illustrating the movable rolls after they have been returned from the threading position to the normal operating position.

The above-defined shape of the slide member 20 and downwardly and outwardly angularly extending leg members 21 of a generally inverted V shape allows movement of the movable rolls 16 to a threading position, as indicated in FIG. 4, on the other side and below the stationary rolls 15 so that the web W may be threaded up in a straightline, linear threading path through the rolls 15 and 16 of the compensator means, as also indicated in FIG. 4.

For this purpose, the rolls 16 may be manually lowered against the bias of the weight device 27 and a latch mechanism 28, as shown in FIG. 4, will engage the upper portion of the slide member 20 and hold the movable rolls 16 in their threading position for straightline linear threading of the web W. The latch 28 is pivotally mounted at 29 on a portion of the housing 14 and has a forward latching beak for engagement with the slide 20 and a rear portion carrying one end of a spring 30 which is also attached to the housing 14 for biasing the latch member 28 into latching engagement. A chain and handle device 31 is attached to the latching member 28 for manual disengagement thereof by the operator after threading up of the web through the compensator means which allows the movable roll 16 to again move the influence of the biasing weight device 27 to their normal operating positions above and one one side of the stationary rolls 15.

The above-described compensator means may be utilized alone in any system in which a web W of continuous material is fed for the purpose of compensating for variable speeds of feed of the web W and maintaining a uniform tension in the material. The compensator means as contained in and carried by the housing 14, may be preferably suspended from the ceiling of a manufacturing plant room for conservation of floor space, as discussed above, or may be positioned on the floor in which the compensator means with movable roll mechanisms 16 and stationary roll mechanisms 15 could be reversed so that the movable rolls 16 normally move toward and away from the stationary rolls 15 from below the stationary rolls.

Preferably, the compensator means, described above, is utilized in conjunction with variable speed, center drive, reversible, winder means positioned adjacent the compensator means for selectively winding or unwinding a roll R of the web W. This variable speed, center drive winder means is preferably in the form of a portable, fluid operated, reversible motor 40 of any suitable, commercially available construction and which is connected with and extends from the compensator means so as to be carried by the housing 14 for connection to and rotation of a mandrel 41 which may be supported on any suitable type of frame 42 for selectively winding or unwinding a roll R of the web material W on the mandrel 41. As illustrated in FIG. 2, the mandrel 41 is removably mounted on a suitable portable frame 42 which may be moved into and out of position for winding or unwinding a roll R of the traveling web W. Thus, the fluid operated, portable, reversible motor 40 is carried by the housing 14 and is controlled by mechanisms therein, to be described below, so as to provide a space saving, self contained, web winder and compensator apparatus which may be suspended from the ceiling of a manufacturing plant room and the winder motor 40 thereof connected with any suitable, portable, frame supported mandrel 41 for the winding or unwinding of the roll R of the web W.

The above-described web winder and compensator apparatus 10 further includes control means including means 43 for sensing the diameter of the web roll R being wound or unwound and being operatively connected between the compensator means and the winder means for controlling the winding or unwinding speed of the winder motor 40 in relation to and in response to the speed of travel of the web W through the compensator means and indicated by the position of the movable rolls 16 of the compensator means and the diameter of the web roll R as indicated by the sensing means 43 for maintaining a uniform tension on the web material being wound or unwound. The control means of the web winder and compensator apparatus include the following.

Figure 3:
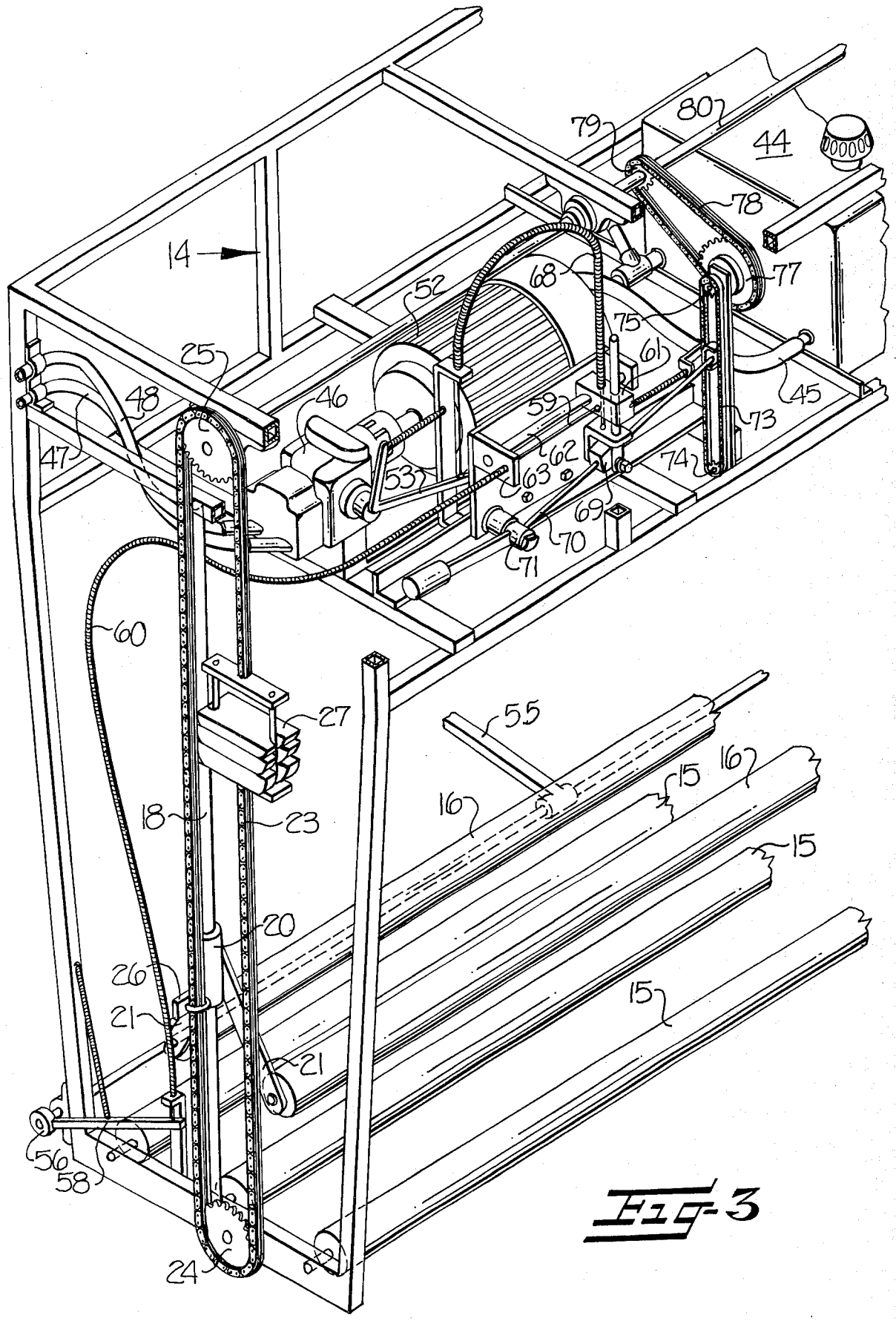
FIG. 3 is an enlarged, partial, perspective view, with side plates of the framework removed, of a portion of the apparatus of this invention.

A fluid reservoir or source 44 is mounted in and carried by the housing 14, as indicated in FIG. 3. A fluid circuit is carried by the housing 14 and is connected with the fluid source or reservoir 44 and with the fluid operated, reversible motor 40 for supplying fluid from the reservoir 44 through the motor 40 for selectively actuating the motor 40 for forward or reverse rotation. The fluid circuit includes a fluid conduit 45 leading from the fluid reservoir 44 to a pump and valve means 46, to be described below. Fluid conduits 47 and 48 connected between the pump and valve means 46 and the motor 40. The fluid circuit further includes a fluid conduit 49 leading from the pump and valve means 46 back to the fluid reservoir 44. This conduit 49 may include a cooling device 50 of any desired construction for the cooling of the fluid being circulated through the circuit.

The fluid pump and valve means 46 is also mounted within the housing 14 for pumping fluid from the reservoir 44 through the above-described fluid circuit to the fluid operated motor 40 for forward or reverse rotation thereof and for regulating the pressure of the fluid being pumped for varying the speed of rotation of the motor. The fluid pump and valve means 46 may be of any suitable construction, such as commercially available from Sun Strand Hydro-Transmission Company, Model 15-2008, of Ames, Iowa. This pump and valve means 46 is suitably driven by an electric motor 52 carried within the housing 14 and is regulated by a regulator handle 53 such that the position of the regulator handle 53 will determine the speed of pumping of the valve and pump means 46 for controlling the speed of the fluid operated motor 40 and the direction of rotation of the fluid operated motor 40.

The control means of the web winder and compensator apparatus further include means carried by the housing 14 and operatively connected between the regulator handle 53 of the pump and valve means 46 and the movable rolls 16 and the roll diameter sensing means 43 for controlling the position of the regulator handle 53 and thus the operation of the pump and valve means 46 in relation to and in response to the speed of travel of the web W through the compensator means and the diameter of the web roll R. This means comprises broadly an interconnected flexible cable mechanism, as follows.

The roll diameter sensing means 43 is in the form of a lever 55 pivotally mounted on a rod 56 carried by the housing 14 and biased into engagement with the web roll R by a spring 57. The rod 56 carries a lever arm 58 which is connected to a flexible cable 59 extending through a sheath 60 and connected to a slide member 61 mounted on a slide rod 62 carried by a bracket 63 mounted stationary on the housing 14. Thus, as the lever 55 pivots upwardly and downwardly under the influence of the diameter of the web roll R, the cable 59 will move the slide member 61 along the slide rod 62.

Figure 6:
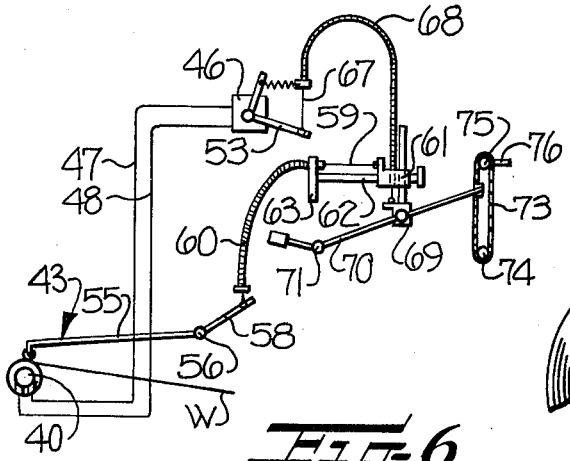
FIGS. 6, 7, 8 and 8 are schematic views illustrating the control devices of the apparatus of this invention in various stages of their operation for compensating for variations in tension and diameter of a web roll being wound or unwound.
Figure 7:
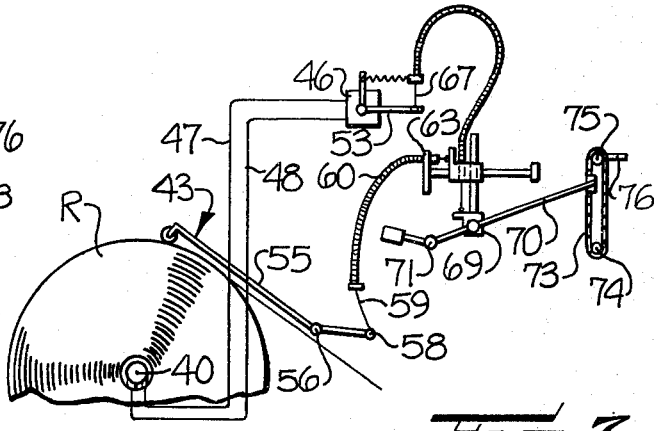

The slide member 61 receives therethrough another flexible cable 57 extending through sheath 68 and having one end thereof connected with another slide member 69 mounted for sliding movement on an angled rod 70. The rod 70 has one end thereof pivotally mounted on the bracket 63 at 71 and the other end thereof connected to a mechanism to be described below. The other end of the flexible cable 67 is connected to the regulator handle 53 of the pump and valve means 46. Thus, for example, as the sensing lever 55 moves upwardly under the influence of an increasing diameter of the roll R, the cable 59 will be pulled downwardly in the sheath 60 to move the slide member 61 to the left, as viewed in FIGS. 1, 6 and 7, which will cause the slide member 69 to move downwardly on the angled slide rod 70 to in turn cause the flexible cable 67 to be pulled downwardly and move the regulator handle 53 upwardly. This motion is illustrated in the schematic FIGS. 6 and 7 and may also be seen in FIG. 1. Movement of the regulator handle 53 of the pump and valve means 46, will vary the pressure of the fluid being pumped therethrough to compensate for speed of rotation of the motor 40 and direction of rotation in accordance with the increasing diameter of the roll R of web material W so as to maintain an even tension in the web W as it is being wound or unwound by the motor 40.

Figure 8:
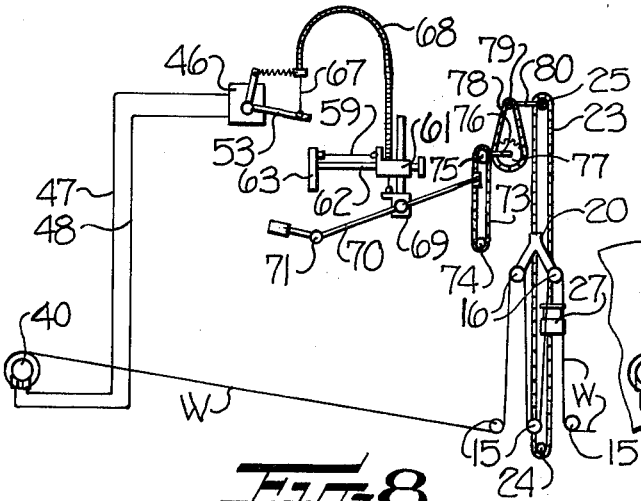
Figure 9:
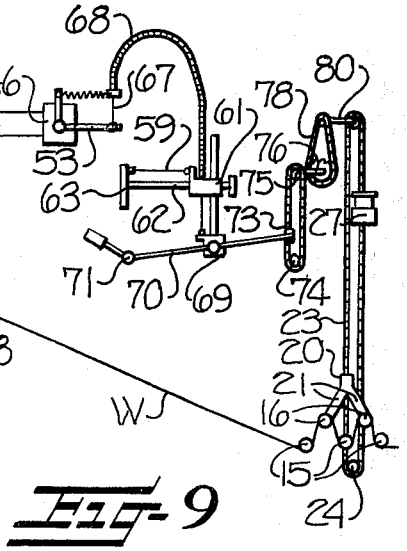

For purposes of compensating for variations in tension as caused by variations in speed of the traveling web W as it passes through the compensator means and the movable rolls 16 and stationary rolls 15 of the compensator means, the slide rod 70 is connected to an endless chain 73 disposed around sprockets 74, 75 mounted on the housing 14. The sprocket 75 has a stub shaft 76 extending therefrom and secured to a sprocket 77 on the other end thereof. The sprocket 77 receives an endless chain 78 which also passes around a sprocket 79 on the end of a stub shaft 80 carried by the housing 14. The stub shaft 80 is connected to the sprocket 25 of the chain and sprocket device 23, 24 and 25. Thus, as may be seen in the schematic illustrations of FIGS. 8 and 9 and in FIG. 1, as the chain 23 is rotated under the influence of movable rolls 16, the chains 78 and 73 will be rotated about their respective sprockets which will change the angle of the slide rod 70 to shorten or lengthen the flexible cable 67 and thus move the position of the regulator handle 53 of the pump and valve means 46. This results in the speed of rotation of the fluid operated motor 40 being controlled through the pump and valve means 46 by the position of the movable rolls 16 as indicated by the tension on the web W as it moves through the compensator means. The degree of regulation of the pump and valve means 46 by the regulator handle device 53 may be set for any desired operation. For example, the pump and the valve means may be set for reversing operation of the motor 40 for every 30° movement of the regulator handle 53.

From the above, it may be clearly seen that the present invention has provided an improved web winder and compensator apparatus with automatic web winding speed compensating controls for selectively winding or unwinding at a uniform tension a roll of traveling continuous web material being selectively fed from or taken up by an associated mechanism and in which the speed of winding or unwinding is compensated for in relation to the diameter of the roll being wound or unwound and the tension on the traveling web as it passes through the compensator mechanism. Additionally, the apparatus of this invention compensates and maintains uniform the tension in the traveling web as it passes through the compensator means. The improved apparatus of this invention provides the desirable features of straightline linear threading of the compensator means and a space saving, self contained construction which may be suspended from the ceiling of a manufacturing plant.

In the drawings and specification there has been set forth a preferred embodiment of the invention and, although specific terms are employed, they are used in a generic and descriptive sense only and not for purposes of limitation.

What is claimed is:

1. An improved web winder and compensator apparatus with automatic web winding speed compensating controls for selectively winding or unwinding at a uniform tension a roll of traveling continuous web material being selectively fed from or taken up by an associated mechanism, said apparatus comprising:

tension compensator means for receiving the traveling web in a predetermined path of travel therethrough and for compensating for variations in speed of travel of the web therethrough for maintaining a uniform tension therein during winding or unwinding thereof, said compensator means comprising stationary roll means positioned in the path of travel of the web for guiding the web through said compensator means, and counterbalanced movable roll means normally positioned on one side of said stationary roll means for receiving the traveling web therearound and moving toward and away from said stationary roll means for decreasing and increasing the length of the path of travel of the web through said compensator means in relation to the tension on the traveling web, said movable roll means including means for movement of said movable roll means to a threading position on the other side of said stationary roll means for straightline linear threading up of the web through said compensator means;

variable speed, center drive, reversible, winder means positioned adjacent said compensator means for selectively winding or unwinding a roll of the web material; and control means including means for sensing the diameter of the web roll in said winder means, said control means being operatively connected between said compensator means and said winder means for controlling the winding or unwinding speed of said winder means in relation to and in response to the speed of travel of the web through said compensator means as indicated by the position of said movable roll means of said compensator means and the diameter of the web roll as indicated by sensing means for maintaining a uniform tension in the web material being wound or unwound.

2. An improved web winder and compensator apparatus, as set forth in claim 1, in which said stationary roll means of said tension compensator means comprises three spaced apart, parallel rolls extending generally transversely of the traveling web, and said movable roll means comprises two spaced apart, parallel rolls extending generally transversely of the traveling web for movement in planes generally passing through the spaces between said three stationary rolls for defining with said stationary rolls a sinuous path of travel for the web therearound.

3. An improved web winder and compensator apparatus, as set forth in claim 2, in which said movable roll means further includes mounting means comprising a slide rod mounted stationary on each side of said two movable rolls and extending generally perpendicular to said movable rolls, a slide member mounted on each of said slide rods for movement up and down said slide rods, each of said slide members being secured to the respective outer ends of said movable rolls for commonly carrying said movable rolls toward and away from said stationary rolls, an endless chain and sprocket means mounted on each side of said movable rolls for movement of said endless chains about said sprockets in a closed path of travel generally perpendicular to said movable rolls, each of said chains being secured respectively to said slide members for movement therewith, and counterbalancing weight means secured to said chain and sprocket means for biasing said movable rolls against the force of gravity and allowing said movable rolls to move away from stationary rolls to lengthen the path of travel of the web through said compensator means when the tension on the traveling web due to the speed of travel thereof is below a predetermined amount and allowing said movable rolls to move toward stationary rolls against the bias thereof under the influence of the traveling web when the tension on the traveling web due to the speed of travel thereof is above a predetermined amount.

4. An improved web winder and compensator apparatus, as set forth in claim 3, in which said slide members include outwardly extending, angularly directed legs secured thereto at one end thereof and secured to said movable rolls at the other end thereof for movement of said movable rolls from the normal operating positions on one side of said stationary rolls to the other side of said stationary rolls for straightline linear threading up of the web through said compensator means.

5. An improved web winder and compensator apparatus, as set forth in claim 1, in which said variable speed, center drive winder means comprises a portable, fluid operated, reversible motor connected with and extending from said compensator means for connection to and rotation of a frame supported mandrel for selectively winding or unwinding a roll of the web material on the mandrel.

6. An improved web winder and compensator apparatus, as set forth in claim 5, in which said control means comprises fluid source means, fluid circuit means connected with said fluid source means and with said fluid operated, reversible motor for supplying fluid from said source through said motor for selectively actuating said motor for forward or reverse rotation, fluid pump and valve means disposed in said fluid circuit means for pumping fluid to said motor for forward or reverse rotation and for regulating the pressure of the fluid being pumped for varying the speed of rotation of said motor, and means operatively connected between said pump and valve means and said movable roll means and said roll diameter sensing means for controlling the operation of said pump and valve means in relation to and in response to the speed of travel of the web through said compensator means and the diameter of the web roll.

7. An improved web winder and compensator apparatus, as set forth in claim 6, in which said means for controlling the operation of said pump and valve means comprises a regulator handle forming part of said pump and valve means and regulating the operation of said pump and valve means according to the position of said regulator handle means, and interconnected flexible cable means operatively connected between said regulator handle of said pump and valve means and said movable roll means and said roll diameter sensing means for moving said regulator handle means in relation to and in response to the relative positions of said movable roll means and said roll diameter sensing means.

8. A space saving, self contained, web winder and compensator apparatus with automatic web winding speed compensating controls for selectively winding or unwinding at a uniform tension a roll of traveling continuous web material being selectively fed from or taken up by an associated mechanism, said apparatus comprising:

housing means for carrying said apparatus and for being suspended from a ceiling of a manufacturing plant room to conserve floor space;

tension compensator means contained within said housing means for receiving the traveling web in a predetermined path of travel therethrough and for decreasing an increasing the length of the path of travel of the web through said compensator means in relation to the tension on the traveling web for compensating for variations in speed of travel of the web to maintain a uniform tension in the traveling web;

portable, variable speed, center drive, reversible, winder motor means carried by and extending from said housing means for connection to and rotation of a frame supported mandrel for selectively winding or unwinding a roll of the web material on the mandrel; and control means generally contained within said housing means and including means extending from said housing means for sensing the diameter of the web roll being wound or unwound, said control means being operatively connected between said compensator means and said winder motor means for controlling the winding or unwinding speed of said winder motor means in relation to and in response to the speed of travel of the web through said compensator means and the diameter of the web roll for maintaining a uniform tension in the web material being wound or unwound.

9. A space saving, self contained, web winder and compensator apparatus, as set forth in claim 8, in which said compensator means comprises a predetermined number of stationary, spaced apart, parallel rolls mounted within said housing means and positioned in the path of travel of the web and extending generally transversely of the traveling web for guiding the web through said compensator means, a predetermined number of movable, counterbalanced, spaced apart, parallel rolls mounted within said housing means and extending generally transversely of the traveling web and normally positioned on one side of said stationary rolls and movable in planes generally passing through the spaces between said stationary rolls for receiving the traveling web therearound and for defining with said stationary rolls a sinuous path of travel for the web and for moving toward and away from said stationary rolls for decreasing and increasing the length of the path of travel of the web through said compensator means in relation to the tension on the traveling web, and said movable rolls including means for movement of said movable rolls to a threading position on the other side of said stationary rolls for straightline linear threading up of the web through said compensator apparatus.

10. A space saving, self-contained, web winder and compensator apparatus, as set forth in claim 9, in which said movable rolls further include mounting means comprising a slide rod mounted stationary on said housing means on each side of said movable rolls and extending generally perpendicular to said movable rolls, a slide member mounted on each of said slide rods for movement up and down said slide rods, each of said slide members being secured to the respective outer ends of said movable rolls for commonly carrying said movable rolls toward and away from said stationary rolls, an endless chain and sprocket means mounted on each side of said movable rolls for movement of said endless chains about said sprockets in a closed path of travel generally perpendicular to said movable rolls, each of said chains being secured respectively to said slide members for movement therewith, and counterbalancing weight means secured to said chain and sprocket means for biasing said movable rolls away from stationary rolls to lengthen the path of travel of the web through said compensator means when the tension on the traveling web due to the speed of travel thereof is below a predetermined amount and allowing said movable rolls to move toward said stationary rolls against the bias thereof under the influence of the traveling web when the tension on the traveling web due to the speed of travel thereof is above a predetermined amount.

11. A space saving, self contained, web winder and compensator apparatus, as set forth in claim 10, in which said slide members comprise generally inverted V-shaped members carrying said movable rolls at the bottom thereof and being mounted on said slide rods and secured to said chain and sprocket means at the top thereof for movement of said movable rolls from the normal operating positions on one side of and above said stationary rolls to the other side and below said stationary rolls for straightline linear threading up of the web through said compensator means.

12. A space saving, self contained, web winder and compensator apparatus, as set forth in claim 8, in which said control means comprises fluid source means carried by said housing means, fluid circuit means disposed within said housing means and connected with said fluid source means and with said fluid operated, reversible motor for supplying fluid from said source through said motor for selectively actuating said motor for forward or reverse rotation, fluid pump and valve means carried by said housing means and disposed in said fluid circuit means for pumping fluid to said motor for forward or reverse rotation and for regulating the pressure of the fluid being pumped for varying the speed of rotation of said motor, and means within said housing means operatively connected between said pump and valve means and said movable rolls and said roll diameter sensing means for controlling the operation of said pump and valve means in relation to and in response to the speed of travel of the web through said compensator means and the diameter of the web roll.

13. A space saving, self contained, web winder and compensator apparatus, as set forth in claim 12, in which said means for controlling the operation of said pump and valve means comprises a regulator handle forming part of said pump and valve means and regulating the operation of said pump and valve means according to the position of said regulator handle means, and interconnected flexible cable means operatively connected between said regulator handle of said pump and valve means and said movable rolls and said roll diameter sensing means for moving said regulator handle means in relation to and in response to the relative position of said movable rolls and said roll diameter sensing means.

14. An improved tension compensator apparatus for receiving a traveling continuous web of material in a predetermined path therethrough and for compensating for variations of the speed of travel of the web therethrough for maintaining a uniform tension in the web and being characterized by ease in threading up of the web of material through said apparatus, said compensator apparatus comprising:

stationary roll means extending generally transversely of the traveling web and positioned in the path of travel of the web for guiding the web through said compensator apparatus;

counterbalanced movable roll means extending generally transversely of the traveling web and generally parallel with said stationary roll means and being normally positioned on one side of said stationary roll means for receiving the traveling web therearound and defining a sinuous path of travel of the traveling web through said compensator means and for moving toward and away from said stationary roll means for decreasing and increasing the length of the path of travel of the web through said compensator means in relation to the tension on the traveling web; and said movable roll means including means for movement of said movable roll means to a threading position on the other side of said stationary roll means for straightline linear threading up of the web through said compensator apparatus.

15. An improved tension compensator apparatus, as set forth in claim 14, in which said stationary roll means comprises three spaced apart, parallel rolls extending generally transversely of the traveling web, and said movable roll means comprises two spaced apart, parallel rolls extending generally transversely of the traveling web for movement in planes generally passing through the spaces between said three stationary rolls for defining with said stationary rolls a sinuous path of travel for the web therearound.

16. An improved tension compensator apparatus, as set forth in claim 15, in which said movable roll means further includes mounting means comprising a slide rod mounted stationary on each side of said two movable rolls and extending generally perpendicular to said movable rolls.

a slide member mounted on each of said slide rods for movement up and down said slide rods, each of said slide members being secured to the respective outer cells of said movable rolls for commonly carrying said movable rolls toward and away from said stationary rolls, an endless chain and sprocket means mounted on each side of said movable rolls for movement of said endless chains about said sprockets in a closed path of travel generally perpendicular to said movable rolls, each of said chains being secured respectively to said slide members for movement therewith, and counterbalancing weight means secured to said chain and sprocket means for biasing said movable rolls against the force of gravity and allowing said movable rolls to move away from stationary rolls to lengthen the path of travel of the web through said compensator means when the tension on the traveling web due to the speed of travel thereof is below a predetermined amount and allowing said movable rolls to move toward stationary rolls against the bias thereof under the influence of the traveling web when the tension on the traveling web due to the speed of travel thereof is above a predetermined amount.

17. An improved tension compensator apparatus, as set forth in claim 16, in which said slide members include outwardly extending, angularly directed legs secured thereto at one end thereof and secured to said movable rolls at the other end thereof for movement of said movable rolls from the normal operating positions on one side of said stationary rolls to the other side of said stationary rolls for straightline linear threading up of the web through said compensator apparatus.

* * * * *

UNITED STATES PATENT OFFICE
CERTIFICATE OF CORRECTION

PATENT NO. : 3,934,837
DATED : January 27, 1976
INVENTOR(S) : Hans O. Keilhack and Peter Schmidt It is certified that error appears in the above-identified patent and that said Letters Patent are hereby corrected as shown below:

Column 3, Line 23, "maintain" should be --material--;
Column 3, Line 41, "wider" should be --winder--;
Column 3, Line 67, "8" 2nd. occurrence should be --9--;
Column 4, Line 65, "be" should be --the--;
Column 5, Line 29, "mvoe" should be --move--;
Column 6, Line 16, "one" first occurrence should be --on--;
Column 6, Line 65, "and" should be --as--;
Column 7, Line 63, "57" should be --67--;
Column 14, Line 22, "cells" should be --ends--.

Signed and Sealed this
*fourth* Day of *May 1976*

[SEAL]

*Attest:*

RUTH C. MASON
*Attesting Officer*

C. MARSHALL DANN
*Commissioner of Patents and Trademarks*